United States Patent [19]

Weatherford, Jr.

[11] 4,008,757

[45] Feb. 22, 1977

[54] INDUSTRIAL TECHNIQUE

[75] Inventor: Larry Green Weatherford, Jr., Mount Vernon, Ind.

[73] Assignee: The Babcock & Wilcox Company, New York, N.Y.

[22] Filed: Sept. 22, 1975

[21] Appl. No.: 615,318

[52] U.S. Cl. ..... 165/67; 176/87; 122/510

[51] Int. Cl.[2] ..... F28F 9/00

[58] Field of Search ..... 165/67; 176/87; 248/19, 248/346; 52/167, 169; 137/376

[56] References Cited

UNITED STATES PATENTS

| | | | |
|---|---|---|---|
| 1,840,741 | 1/1932 | Reid | 248/19 |
| 2,680,259 | 6/1954 | Milk | 214/19 UX |
| 3,554,868 | 1/1971 | Thorp | 176/87 |
| 3,771,499 | 11/1973 | Marroni, Jr. | 176/87 |

*Primary Examiner*—C. J. Husar
*Assistant Examiner*—Theophil W. Streule, Jr.
*Attorney, Agent, or Firm*—J. M. Maguire; J. P. Sinnott

[57] ABSTRACT

A typical embodiment of the invention provides a structural support for large pressure vessels. Illustratively, the lower surface of a forging on the bottom of the pressure vessel has a keyway slot. A support plate with a mating key that is received within the slot is bolted to the bottom forging. The lower surface of the support plate, moreover, has an arcuate surface that presses against a matching lubricated surface to transmit the entire vertical load to a concrete pedestal that has a means for cooling the concrete structure.

4 Claims, 1 Drawing Figure

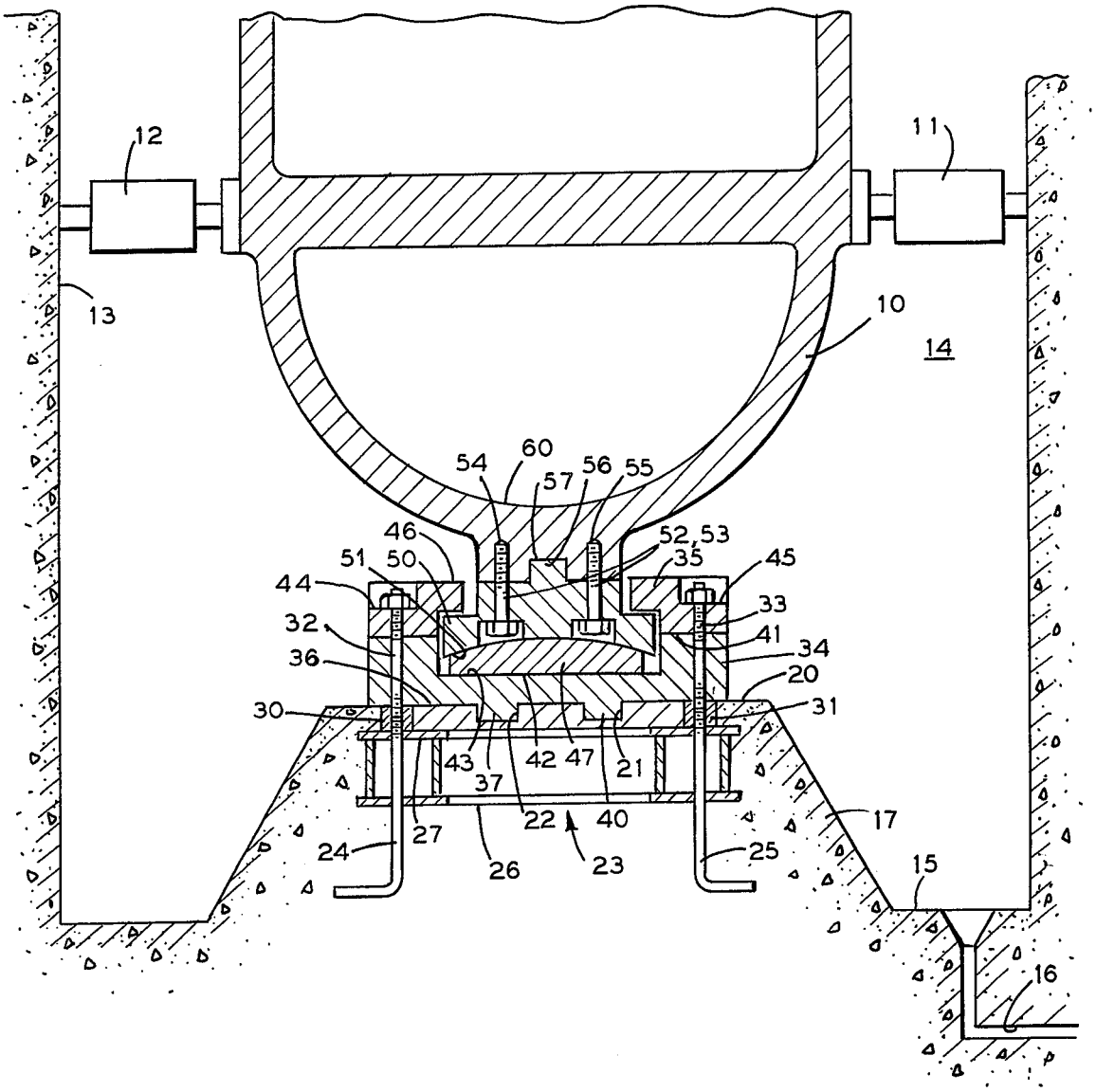
12
11
13
10
14
54
60
57
56
55
46
52,53
51
50
35
45
44
33
32
41
34
36
20
30
31
43
42
47
21
37
22
40
17
24
27
26
23
25
15
16

INDUSTRIAL TECHNIQUE

BACKGROUND OF THE INVENTION

1. Field of the Invention

This invention relates to the structural supports and, more specifically, to a lubricated sliding structure for supporting massive heat exchangers, and the like.

2. Description of the Prior Art

There is a need to support extremely large heat exchangers, pressure vessels and other devices in a manner that protects these structures from the effects of earthquakes as well as the structural shocks that may be caused by large, abrupt changes in pressure vessel temperature. This structural support, moreover, must be provided in a manner that permits adjustment to routine thermal expansion and contraction and affords a reasonable degree of access for inspection, maintenance and repair.

More specifically, in commercial nuclear power plants there is a need for large heat exchangers that may be forty feet in diameter and as tall as seventy feet, when erected. Because these heat exchangers operate at high temperatures, care must be taken to insure that the temperature of the concrete portions of the structure that support a heat exchanger of this size do not exceed 200° F, or the concrete will lose its water for hydration or crystallization and ultimately turn into a powder. Because of the large structures that are involved, the effects of thermal expansion and contraction appear in these devices as size changes that are on the order of several inches. In view of these largescale effects, if the heat exchanger experiences a swift change in temperature through an accidental loss of one of the hot fluids within, it is believed that the device will thermally contract with sufficient speed to produce a massive, jarring impact with surrounding structures. In a similar manner, earth tremors and the like also might produce serious damage if the seismic forces are coupled to one of these large heat exchangers.

It has been suggested to secure a support plate to the lower end of the heat exchanger. The bottom of this plate is provided with a concave arcuate surface that rests upon a corresponding convex Lubrite plate, or other suitably lubricated bearing surface. Because the Lubrite plate would ultimately rest upon a concrete foundation, the downward vertical load imposed by the heat exchanger is absorbed in a manner that permits the structure to slide or to shift through small horizontal distances relative to the lubrite plate in order to safely accommodate some of the motions that are induced by these extraordinary forces.

The structure that characterizes this proposal, however, appears to raise the temperature of the concrete foundation to unacceptably high levels and also fails to provide some means for coping with upward vertical forces and horizontal forces that are of a substantial magnitude. Thus, there is a need for a heat exchanger support structure that keeps the foundation at an acceptable temperature while permitting the relative movement of the heat exchanger and support structure to slide through small distances in order to adjust to relatively minor dislocations, and also to absorb major horizontal and upward vertical forces that are caused by earthquakes, abrupt changes in heat exchanger temperature, and the like.

SUMMARY OF THE INVENTION

These and other shortcomings of the prior art are overcome, to a large extent, through the practice of the invention. More particularly, a shear ring is placed over the peripheral portion of the support plate. The shear ring also extends well within the margin or perimeter of of the support plate in order to engage the vertical threaded ends of an array of anchor bolts that extend into and are embedded in the concrete foundation. In this manner, the anchor bolts and shear ring transmit upward vertical forces directly into the foundation. In cooperation with the anchor bolts, a key and keyway slot are formed in the mutually engaged surfaces of the heat exchanger's lower forging and the support plate in order to absorb transverse or horizontal forces that are applied to the heat exchanger through earthquakes or other major physical disturbances.

Because the steel that is required for this structure also is an excellent conductor of heat, it is likely that surrounding portions of the concrete foundation will be raised to an inacceptable temperature during ordinary operating conditions. In accordance with a feature of the invention, however, a hollow steel ring, implanted in the concrete foundation adjacent to the anchor bolt structure not only increases the strength of the foundation but also provides sufficient cooling capacity to keep the concrete temperature from exceeding a predetermined hevel.

To further enhance the physical resistance of the heat exchanger to transverse forces, it may be preferable to interpose a base plate between the convex lubricated plate and the concrete foundation. In this circumstance, it is advisable to form one or more shear pins in the base plate. These pins protrude from the base plate into mating recesses or bores that are prepared in the opposing surface of the concrete foundation.

Thus, the invention provides a means that enables the foundation and the heat exchanger to rotate and to slide through limited distances relative to each other in order to absorb lower levels of applied transverse and longitudinal forces. The more massive steel structure, however, that is required to withstand greater shocks also is provided in the form of shear keys, anchor bolts and shear pins in a manner, however, that does not increase the temperature of the concrete foundation to an unsatisfactory level. This latter feature of the invention, characterized by the hollow steel ring embedded in the foundation concrete, not only cools the concrete to a suitable temperature but provides the further and unanticipated advantage of enhancing the strength of the concrete.

The various features of novelty which characterize the invention are pointed out with particularity in the claims annexed to and forming a part of this specification. For a better understanding of the invention, its operation, advantages and specific objects attained by its use, reference should be had to the accompanying drawing and descriptive matter in which there is illustrated and described a preferred embodiment of the invention.

BRIEF DESCRIPTION OF THE DRAWING

The sole FIGURE of the drawing shows, in full section, an illustrative heat exchanger support that embodies principles of the invention.

DETAILED DESCRIPTION OF THE PREFERRED EMBODIMENTS

For a more complete appreciation of the invention, attention is invited to the drawing. As shown, a vertically positioned heat exchanger 10 is supported, in part, by means of an array of horizontally disposed lateral supports 11, 12. The lateral supports each are secured on the one end to a vertical surface of the heat exchanger 10 and, on the other, through a shock absorber, or the like, to a vertical wall 13 of reinforced concrete. The concrete wall 13 forms part of a well 14 that receives the heat exchanger 10. A horizontal floor 15, also of reinforced concrete, forms the bottom of the well 14. Within the floor 15, a drain 16 is formed at the floor low point to enable water from any source to concentrate for pumping out of the well 14.

A reinforced concrete support or foundation 17, illustratively formed in the shape of a truncated cone or pyramid, has a generally flat upper surface 20. The surface 20, however, has a group of generally cylindrical recesses or bores 21, 22 that protrude down into the foundation structure. To provide cooling for the foundation 17, as well as to enhance the strength of the foundation, a hollow annular steel box spar 23 is embedded in the foundation concrete immediately below the bottom of the bores 21, 22.

Anchor bolts, of which only anchor bolts 24, 25 are shown in the drawing, are arranged in a circular array relative to the transverse plane of the upper surface 20 on the foundation 17. Each of the bolts 24, 25 is formed in the shape of an ell, in which the long shank is parallel to the longitudinal axis of the heat exchanger 10 and perpendicular to the plane of the foundation's upper surface 20. The shorter shank of the anchor bolt ell is, however, perpendicular to the axis of the long shank to further secure the bolt structure within the foundation 17. The long shank of each respective one of the anchor bolts 24, 25, moreover, passes through aligned apertures in lower flange 26 and upper flange 27 of the box spar 23. Each long shank of the individual anchor bolts 24, 25 terminates in a threaded end that is received in a respective tapped fitting of which only fittings 30, 31 are illustrated.

As shown, the fittings 30, 31, when fully engaged with the threaded ends of the anchor bolts 24, 25 bear against the upper flange 27 and are flush with the upper surface 20 on the foundation 17. There is, moreover, a substantial depth of threading within each of the fittings 30, 31 that is not engaged with the respective anchor bolts 24, 25. This threading in the fittings 30, 31, however, does engage threaded lower portions of the shanks of a set of bolts, of which the drawing only shows bolts 32, 33, respectively.

The bolts 32, 33 pass through aligned apertures in a base plate and bearing ring 34 and another set of aligned apertures in a shear ring 35 that is superimposed on the upper surface of the bearing ring 34.

Typically, the bearing ring 34 has a lower surface 36 from which an array of generally cylindrical shear pins 37, 40 protrude vertically downward. The shear pins 37, 40 are received in the mating recesses or bores 22, 21, respectively, that are formed in the upper surface 20 of the foundation 17. The bearing ring 34, moreover, also has an annular upper surface 41 that accommodates a large circular bore 42 with a flat horizontal base 43 and cylindrical walls.

The shear ring 35 is generally annular in shape and is superimposed on the annular upper surface 41 of the bearing ring 34. Recesses 44, 45 are formed in the outer perimeter of the annular surface 41 to accommodate the heads of the respective bolts 32, 33. A flange 46 protrudes inwardly toward the center of the shear ring 35 to overhang a marginal portion of the circular base 43 that is formed in the base plate 34.

A Lubrite plate 47, or other suitably lubricated plate member, that has a flat lower surface which rests upon the horizontal base 43 also has a diameter which is significantly greater than the inner diameter of the overhanging flange 46 on the shear ring 35. This diameter of the Lubrite plate 47, however, is smaller than the diameter of the circular bore 42 in which it is received. This difference in relative diameters provides some clearance for relative movement between the Lubrite plate 47 and the base plate 34.

Typically, a Lubrite plate may comprise a bronze or brass alloy base in which a number of surface rings have been machined. These rings are filled with a graphite base lubricant which, as the contact surface between the Lubrite plate 47 and the horizontal base 43 wear away through a period of time, exposes new lubricant. Suitable Lubrite plates are manufactured, for example, by the Merriman Division of Litton Industries, 100 Industrial Park Road, Hingham, Massachusetts 02043.

The upper surface of the Lubrite plate 47, moreover, is convex, and is also treated in the above-described manner to provide suitable lubrication. Further in this respect, a forged support block 50 has a concave lower surface 51 that conforms with and rests upon the matching convex upper lubricated surface of the Lubrite plate 47. A circularly disposed and longitudinally aligned array of bores, of which only bores 52, 53 are shown have countersunk recesses formed in the concave surface each to accommodate respective bolts, only the bolts 54 and 55 having been shown in the drawing.

The upper surface of the support block 50 has a lower extending flange with a diameter which is somewhat greater than the diameter of the underlying Lubrite plate 47, but which is, nevertheless, still smaller than the diameter of the circular bore 42 that is formed in the base plate 34 in order to provide sufficient clearance to permit the heat exchanger 10 to move relative to the foundation 17. A shear key 56 is diametrically disposed on the upper surface of the support block 50. The shear key 56 is seated in a keyway slot 57 that is formed in a lower contact face in lower forging 60 that forms a portion of the heat exchanger 10. As illustrated in the drawing, the bolts 54, 55 as well as the other bolts that serve to connect the support block 50 with the lower forging 60 which are out of the plane of the drawing, are received in tapped bores that are cut into the lower forging 60.

In operation, the concrete foundation 17 is poured to expose only the upper surfaces of the anchor bolt fittings 30, 31. A template is made of the location of these fittings after the concrete has set. With the aid of this template (not shown in the drawing), the matching bores are drilled in the base plate 34 and the shear ring 35 in alignment with the respective anchor bolt fittings 30, 31.

The base plate 34 is positioned over the fittings 30, 31 on the upper surface 20 of the foundation 17. The Lubrite plate 47, moreover, is positioned in the center of the circular bore 42 that is formed in the base plate 34. To fully assemble the support structure, the shear ring 35 is placed over the lower forging 60 on the heat exchanger 10 and the support block 50 is bolted into place. The heat exchanger 10, the support block 50 and the shear ring 35 subassembly is then carefully placed in position on the base plate 34 and the Lubrite plate 47 to align the bolt holes in the shear ring 35 with the corresponding bolt holes in the base plate 34 and the fittings 30, 31 that are embedded the concrete foundation 17. The entire assembly is completed by inserting the bolts 32, 33 into the aligned bores and then threading these bolts into the fittings 30, 31 to a desired torque.

If the application of a horizontal force to the heat exchanger 10 or to the foundation 17 is of sufficient magnitude to move these structures relative to each other, the initial motion should be absorbed without damage through the sliding and rotating movement of the support block 50 relative to the Lubrite plate 47. Vertical upward forces, moreover, will be transmitted from the peripheral margin of the support block 50 to the flange 46 on the shear ring 35 and through the bolts 32, 33 to the foundation 17 by way of the anchor bolts 24, 25. Should the horizontal forces, however, be great enough to exceed a level that can be dissipated, through relative movement between the support block 50, the Lubrite plate 47 and the horizontal base 43 of the circular bore 42 in the base plate 34, then the shear key 56 in the support block 50, the bolts 54, 55 and the shear pins 37, 40 in the foundation 17 will be able to absorb the balance of the otherwise unabsorbed force.

There are, of course, many modifications that can be applied to the foregoing structure that are, nevertheless, within the scope of the invention. It is preferable, for example, to eliminate the lower forging 60 in the heat exchanger 10 and to weld a portion of large diameter pipe to the outside of the heat exchanger head, the longitudinal axis of the pipe being coincident with the longitudinal axis of the heat exchanger. A flange of the lowermost end of the pipe is bolted to a forging that has a concave lower surface that matches the curvature of the upper surface of the Lubrite plate 47. This particular construction not only eliminates an extra forging as well as additional machining in the lower head of the heat exchanger 10, but also increases the distance between the heat exchanger and the concrete foundation 17, thereby tending to reduce the temperature of the foundation.

The hollow box spar 23 also lends itself to accommodate a circulating cooling fluid, and thereby to further reduce the operating temperature of the concrete foundation 17.

A further saving in construction costs can be effected if the lateral supports 11, 12 are joined, not to the heat exchanger 10 as shown in the drawing, but to horizontal plates that are attached to the lower forging 60 or, in the case of the pipe welded to the lower head of the heat exchanger 10, that are secured to that pipe, and to adjacent portions of the wall 13 of the well 14. The saving provided by this specific arrangement is particularly noticeable in the reduced requirement for reinforced concrete in the structure of the well 14. Thus, the larger mass of reinforced concrete needed to sustain the action of the lateral supports 11, 12 is close to the floor 15, rather than higher from the floor as shown in the drawing. In this way, a further mass of reinforced concrete that ordinarily is needed to support the concrete portion that is above the floor 15 and adjacent to the lateral supports 11, 12 now is not required.

The embodiments of the invention in which an exclusive property or privilege is claimed are defined as follows:

1. A heat-exchanger support comprising a reinforced concrete foundation, anchor bolts embedded within said foundation for transferring vertical loads from the heat exchanger to the foundation, a box spar embedded within said foundation for cooling said reinforced concrete, a base plate resting on said foundation, said base plate having bores formed therein, each of said bores being in alignment with said anchor bolts, said base plate having a generally centrally disposed cylindrical bore that terminates in a base, a lubricated plate member in said cylindrical bore, resting on said base and having a diameter that is smaller than the diameter of said cylindrical bore, said lubricated plate also having a convex surface, an annular shear ring having bores formed in alignment with said respective anchor bolts, said shear ring being superimposed on said base plate and having an inner diameter that is smaller than said lubricated plate diameter in order to overhang a peripheral margin of said lubricated plate, a support block having a concave surface in contact with said lubricated plate convex surface, said support block having a diameter that is greater than said lubricated plate diameter and less than said cylindrical bore diameter in order to partially underlie said shear ring, and means connecting said support block to the heat exchanger.

2. An heat exchanger support according to claim 1 further comprising shear pins depending from said base plate and protruding into said reinforced concrete foundation.

3. A heat exchanger support according to claim 1 further comprising a shear key interposed between said support block and said means connecting said support block to the heat exchanger in order to absorb shear forces.

4. A heat exchanger support according to claim 1 further comprising a box spar embedded in said reinforced concrete foundation in order to cool said foundation.

* * * * *